United States Patent [19]

Katafuchi

[11] Patent Number: 4,828,731

[45] Date of Patent: May 9, 1989

[54] LUBRICATING OIL COMPOSITION FOR WORKING METAL

[75] Inventor: Tadashi Katafuchi, Ichihara, Japan

[73] Assignee: Idemitsu Kosan Co., Ltd., Tokyo, Japan

[21] Appl. No.: 261,921

[22] Filed: Oct. 24, 1988

[30] Foreign Application Priority Data

Nov. 7, 1987 [JP] Japan ..... 62-280314

[51] Int. Cl.[4] ..... C10M 101/02

[52] U.S. Cl. ..... 252/32.7 E; 252/45; 252/52 A; 252/52 R; 252/56 R; 252/58; 72/42

[58] Field of Search ..... 252/32.7 E, 45, 56 R, 252/58, 52 A; 72/42

[56] References Cited

U.S. PATENT DOCUMENTS 3,869,396 3/1975 Van de Kraats ..... 252/56 R 4,146,492 3/1979 Casano et al. ..... 252/56 R 4,149,984 4/1979 Wenzel et al. ..... 252/56 R 4,776,967 10/1988 Ichihashi et al. ..... 252/56 R

*Primary Examiner*—Jacqueline V. Howard

*Attorney, Agent, or Firm*—Frishauf, Holtz, Goodman & Woodward

[57] ABSTRACT

A lubricating oil composition for working metal which comprises (A) a base oil containing a mineral oil having a kinematic viscosity at 40° C. ($V_{40}$) of 5 to 150 cSt, viscosity-pressure coefficient at 40° C. ($\alpha_{40}$) satisfying the expression:

$$\alpha_{40} \leqq 2.800 \log(V_{40}) + 14.200$$

and a pour point of not higher than −35° C., and (B) one or two of an oilness agent and an extreme pressure agent.

5 Claims, No Drawings

LUBRICATING OIL COMPOSITION FOR WORKING METAL

BACKGROUND OF THE INVENTION

1. Field of the Invention

The present invention relates to a lubricating oil composition for working metal, and more particularly, to a lubricating oil composition for working metal of oil type or emulsion type excellent in workability, produced by compounding oiliness agent and the like with a base oil containing a mineral oil having specified properties.

2. Description of the Related Art

Lubricating oils used in working metal have not heretofore been researched so particularly, and accordingly there are few literatures discussing the relations between the kinds or the properties of base oils for lubricating oils and their effects.

Generally, the representative examples of the base oils for lubricating oils for working metal used widely are naphthene base mineral oil and paraffin base mineral oil conventionally known, but these oils have various disadvantages. When a known naphthene base mineral oil is used, for instance, the surface finishing of the workpiece will become poor, especially in luster. When a paraffin base mineral oil is used, resulting luster will be better than that obtained by the use of a naphthene base mineral oil, but there will be caused a problem that the surface finishing becomes insufficient under severe conditions for metal working.

SUMMARY OF THE INVENTION

An object of the present invention is to provide a lubricating oil for working metal which accompanies a favorable surface finishing of the workpiece irrespective of the conditions for metal working.

Another object of the present invention is to provide a lubricating oil excellent in metal workability.

The present invention relates to a lubricating oil composition for working metal comprising (A) a base oil containing a mineral oil having a kinematic viscosity at 40° C. ($V_{40}$) of 5 to 150 cSt, a viscosity-pressure coefficient at 40° C. ($\alpha_{40}$) satisfying the expression:

$$\alpha_{40} \leqq 2.800 \log (V_{40}) + 14.200 \quad \text{(I)}$$

and pour point of not higher than −35° C., and (B) an oiliness agent and/or an extreme pressure agent.

DESCRIPTION OF THE PREFERRED EMBODIMENTS

The composition of the present invention consists essentially of a base oil containing a mineral oil of a particular properties as Component (A) and an oiliness agent and/or an extreme pressure agent as Component (B). Herein the kinematic viscosity at 40° C. ($V_{40}$) of the mineral oil is in the range of 5 to 150 cSt, preferably 6to 100 cSt. If the kinematic viscosity ($V_{40}$) is less than 5 cSt, the lubricity becomes poor. On the other hand, if it is in excess of 150 cSt, annealing and defatting after working become difficult.

The viscosity-pressure coefficient ($\alpha_{40}$) of the above-mentioned mineral oil should inevitably satisfy the beforementioned expression (I):

$$\alpha_{40} \leqq 2.800 \log (V_{40}) + 14.200 \quad \text{(I)}$$

(log indicates common logarithms).

With mineral oils having viscosity-pressure coefficient ($\alpha_{40}$) that do not satisfy the above expression, the surface luster of the workpiece results poor. Herein the viscosity-pressure coefficient ($\alpha_{40}$) means the coefficient of the change in viscosity by the pressure defined by the expression (II):

$$\alpha_{40} = \frac{\ln(\eta_p) - \ln(\eta_0)}{P} \quad \text{(II)}$$

(wherein $n_p$ shows the viscosity at the temperature of 40° C., under the pressure of P (giga-pascal), and $\eta_o$ shows the viscosity at the temperature of 40° C., under the atmospheric pressure. ln shows natural logarithms.)

Furthermore, the pour point of the above-mentioned mineral oil is not higher than −35° C., preferably not higher than −40° C. Herein if the pour point is higher than −35° C., the surface finishing of the workpiece becomes insufficient under severe conditions of metal working.

A preferable example of the mineral oil having the properties as mentioned above is the deep dewaxed oil which is obtained by purifying a distillate oil with the usual method, having been obtained by atmospheric distillation of a paraffin base crude oil or intermediate base crude oil, or by vaccum distillation of a residual oil resulting from the atmospheric distillation, and further by subjecting the said purified oil to deep dewaxing treatment.

The method for purifying the distillate oil is not critical, but various methods can be employed. Usually, the distillate oil is purified by applying such treatments as (a) hydrogenation, (b) dewaxing (solvent dewaxing or hydrogenation dewaxing), (c) solvent extraction, (d) alkali distillation or sulfuric acid treatment, and (e) clay filtration, alone or in combination with one another. It is also effective to apply the same treatment repeatedly at multi-stages. For example, (1) a method in which the distillate oil is hydrogenated, or after hydrogenation, it is further subjected to alkali distillation or sulfuric acid treatment, (2) a method in which the distillate oil is hydrogenated and then is subjected to dewaxing treatment, (3) a method in which the distillate oil is subjected to solvent extraction treatment and then to hydrogenation treatment, (4) a method in which the distillate oil is subjected to two- or three-stage hydrogenation treatment, or after the two- or three-stage hydrogenation treatment, it is further subjected to alkali distillation or sulfuric acid rinsing treatment.

A mineral oil obtained by deep dewaxing again the purified oil obtained by the above methods, i.e., deep dewaxed oil is particularly preferred at the base oil of the present invention. This dewaxing, called deep dewaxed treatment, is carried out by solvent dewaxing under severe conditions, catalytic hydrogenation dewaxing using a Zeolite catalyst, and so forth.

In the composition of the present invention, a base oil containing the above-mentioned mineral oil is used as Component (A). As well as the above-mentioned mineral oil, other conventional base oils for metal working oil can be compounded in proper amount, usually in the ratio of less than 50% of the total amount in the base oil.

In the composition of the present invention, besides Component (A) mentioned above, one of or both of oiliness agent and extreme-pressure agent as Component (B) should be added. Herein the oiliness agent is not critical, but various agents can be employed. Representative examples are higher fatty acids (including oleic acid, stearic acid), higher fatty acid esters, polycarboxylic acid esters, polyalcohol esters, higher alcohols, fats and oils, chlorinated fats and oils, and metal soaps (containing zinc, lead or copper).

As the extreme-pressure agents, various agents can be employed. The representative examples of extreme-pressure agents are sulfur containing extreme-pressure agents such as sulfides, sulfoxides, sulfones, thiophosphates, thiocarbonates, sulfurized oils and fats, and olefin sulfides; phosphorus containing extreme-pressure agents such as phosphates (including tricresylphosphate (TCP)), phosphites, amine salts of phosphates, amine salts of phosphites; halogen containing extreme-pressure agents including chlorinated hydrocarbon; organometallic extreme-pressure agents such as thiophosphate including zinc dithiophosphate (ZnDTP), thiocarbamic acid salt and the metal salt of salicylic acid or sulfonic acid.

In the composition of the present invention, the ratio of the above Component (B) is not critical, but is 0.1 to 50% by weight of the total amount of composition, preferably 1 to 30% by weight.

Various additives such as corrosion inhibitors and antifoamers can be added further to the composition of the present invention, if desired. The composition of the present invention can be used in oil type as it is, but also can be used in emulsion type by addition of water as well as emulsifying agent.

As described above, according to the lubricating oil composition of the present invention in various metal working, the surface finishing of the workpiece, particularly the luster can be improved, and workability and working efficiency are improved, and said lubricating oil composition is excellent in emulsification stability.

Accordingly, the lubrication oil composition of the present invention is expected to be applied widely and effectively as various metal working oils for plastic work such as rolling and drawing, or cutting or grinding work.

The present invention is described in greater detail with reference to the following examples.

Table 1 shows the properties of the nine mineral oils to be used in the said examples.

EXAMPLES 1 TO 4 AND COMPARATIVE EXAMPLES 1 TO 8

Rolling Test

With the mineral oils (80% by weight) given in Table 1 compounded butylstearate (20% by weight) to prepare a sample. A rolling test was performed using the sample oil as rolling oil. The test was conducted by 4-pass rolling test, using a precision four-step roller. The conditions for this rolling test are as follows.

Rolled material: Annealed SUS304
Rolling rate: 200 m/min
Working roll:
diameter: 40 mm,
material: SUJ-2 steel,
surface roughness: 0.2 s
Pass schedule:
(1) 2.0—1.3—0.8—0.6—0.4 (mm)
(2) 2.0—1.2—0.7—0.5—0.35 (mm)

The evaluation of the properties of the said rolling oil was made with the luster of rolled material after 4-pass rolling test by 60° specular gloss method according to JIS-Z8741. The results are shown in Table 2.

TABLE 1

| | Kinematic Viscosity at 40° C. ($V_{40}$) (cSt) | Viscosity-pressure*1 coefficient at 40° C. ($\alpha_{40}$) ($GPa^{-1}$) | Pour point (°C.) | Remarks |
|---|---|---|---|---|
| Mineral oil $A_1$ | 8.362 | 15.5 | −42.5 | Deep dewaxed oil |
| Mineral oil $B_1$ | 31.37 | 17.8 | −42.5 | Deep dewaxed oil |
| Mineral oil $C_1$ | 106.6 | 18.6 | −42.5 | Deep dewaxed oil |
| Mineral oil $A_2$ | 8.098 | 15.4 | −10 | Hydrogenated oil |
| Mineral oil $A_3$ | 8.370 | 18.6*2 | −50 | Naphthene base oil |
| Mineral oil $B_2$ | 30.38 | 16.3 | −15 | Solvent-purified oil |
| Mineral oil $B_3$ | 29.41 | 21.0*2 | −42.5 | Naphthene base oil |
| Mineral oil $C_2$ | 100.3 | 18.3 | −15 | Solvent-purified oil |
| Mineral oil $C_3$ | 104.5 | 24.4*2 | −30 | Naphthene base oil |

*1By the use of a falling ball viscosity meter, the viscosity ($\eta_p$) at 40° C., under 0.5 giga-pascal (GPa) was found. and $\alpha_{40}$ was calculated out from the viscosity ($\eta_o$) at atmospheric pressure and a pressure (P = 0.5 GPa) according to the expression(II).
*2The value of $\alpha_{40}$ does not satisfy the abovementioned expression(I).

TABLE 2

| No. | Sample Component (A) | Sample Component (B) | Pass schedule | Luster at 4th pass |
|---|---|---|---|---|
| Example 1 | Mineral oil $A_1$ | Butylstearate | (1) | 760 |
| Example 2 | Mineral oil $A_1$ | Butylstearate | (2) | 803 |
| Example 3 | Mineral oil $B_1$ | Butylstearate | (1) | 728 |
| Example 4 | Mineral oil $B_1$ | Butylstearate | (2) | 740 |
| Comparative Example 1 | Mineral oil $A_2$ | Butylstearate | (1) | 763 |
| Comparative Example 2 | Mineral oil $A_2$ | Butylstearate | (2) | 782 |
| Comparative Example 3 | Mineral oil $A_3$ | Butylstearate | (1) | 745 |
| Comparative Example 4 | Mineral oil $A_3$ | Butylstearate | (2) | 750 |
| Comparative Example 5 | Mineral oil $B_2$ | Butylstearate | (1) | 725 |
| Comparative | Mineral oil $B_2$ | Butylstearate | (2) | 730 |

TABLE 2-continued

| No. | Sample Component (A) | Component (B) | Pass schedule | Luster at 4th pass |
|---|---|---|---|---|
| Example 6 | | | | |
| Comparative Example 7 | Mineral oil $B_3$ | Butylstearate | (1) | 704 |
| Comparative Example 8 | Mineral oil $B_3$ | Butylstearate | (2) | 713 |

EXAMPLES 5 AND 6 AND COMPARATIVE EXAMPLES 9 TO 12

Drawing Test

To the mineral oils (80% by weight) in Table 1 compounded sulfurized oils and fats (20% by weight) to prepare samples, and a drawing test was carried out by the use of the samples as the working oil. The conditions of the said drawing test are as follows.

Workpiece: JIS-SPCE (2.0 mm in thickness)
Diameter of punch: 31.4 mm
Diameter of workpiece: 50 mm
Drawing rate: 0.5 m/sec.
Way of lubricating: coating The evaluation of the above samples was performed by visual observation of the surface properties on the workpiece after drawing. The result is shown in Table 3.

TABLE 3

| No. | Sample Component (A) | Component (B) | Surface properties of the workpiece (oilpit) |
|---|---|---|---|
| Example 5 | Mineral oil $B_1$ | Sulfurized oils and fats | none |
| Example 6 | Mineral oil $C_1$ | Sulfurized oils and fats | few |
| Comparative Example 9 | Mineral oil $B_2$ | Sulfurized oils and fats | few |
| Comparative Example 10 | Mineral oil $B_3$ | Sulfurized oils and fats | moderate |
| Comparative Example 11 | Mineral oil $C_2$ | Sulfurized oils and fats | many |
| Comparative Example 12 | Mineral oil $C_3$ | Sulfurized oils and fats | heavy |

EXAMPLE 7 AND COMPARATIVE EXAMPLES 13 AND 14

TABLE 4

| No. | Sample Component (A) | Component (B) | Damage of Tools (Abnormalous abrasion in edges) |
|---|---|---|---|
| Example 7 | Mineral oil $B_1$ | Sulfurized oils and fats, Chlorinated paraffin | none |
| Comparative Example 13 | Mineral oil $B_2$ | Sulfurized oils and fats, Chlorinated paraffin | Slight |
| Comparative Example 14 | Mineral oil $B_3$ | Sulfurized oils and fats, Chlorinated paraffin | heavy |

Cutting Test

To the mineral oils (97% by weight) of Table 1 compounded sulfurized fats and oils (2% by weight) and chlorinated paraffin (1% by weight) to prepare samples and Fly Tool Test was performed by the use of the samples as cutting oil. The result is shown in Table 4. Conditions of the test are as follows.

SHAPE OF THE TOOL

Tool angle: 0.5 R
Pressure angle: 18°12'
Rake angle: 0°.
Material of workpiece: SCM-420.
Cutting rate: 100 m/min (187 rpm).
Feed rate: 2.4 mm.
Entering rate: 0.9 mm
Direction of cutting: Upward.

EXAMPLE 8 AND COMPARATIVE EXAMPLES 15 AND 16

Emulsification Stability Test

In a 100 ml measuring cylinder, 5% aqueous solution of mixture of 80% by weight of the mineral oils in Table 1, 10% by weight of emulsifying agent (polyoxyethylenenonylphenyl ether) and 10% by weight of chlorinated paraffin (chlorine content : 40%) was prepared to be samples.

The samples were shaken 50 times to make emulsions, and then the stability at the temperature of 5° C. after 24 hours was observed. The result is shown in Table 5.

TABLE 5

| No. | Sample Component (A) | Component (B) | Stability (Appearance) |
|---|---|---|---|
| Example 8 | Mineral oil $A_1$ | Emulsifying agent, chlorinated paraffin | homogeneous |
| Comparative Example 15 | Mineral oil $A_2$ | Emulsifying agent, chlorinated paraffin | cream layer: 2% |
| Comparative Example 16 | Mineral oil $A_3$ | Emulsifying agent, chlorinated paraffin | homogeneous |

What is claimed is:

1. A lubricating oil composition for working metal which comprises (A) a base oil containing a mineral oil having a kinematic viscosity at 40° C. ($V_{40}$) of 5 to 150 cSt, viscosity-pressure coefficient at 40° C. ($\alpha_{40}$) satisfying the expression:

$$\alpha_{40} \leqq 2.800 \log (V_{40}) + 14.200$$

and a pour point of not higher than −35° C., and (B) one or two of an oilness agent and an extreme pressure agent.

2. A lubricating oil composition for working metal as claimed in claim 1 wherein (A) a base oil is deep dewaxed oil.

3. A lubricating oil composition for working metal as claimed in claim 1 wherein a pour point of the base oil is not higher than −40° C.

4. A lubricating oil composition for working metal as claimed in claim 1 wherein the ratio of Component (B) is 0.1 to 50% by weight of the total amount of the composition.

5. A method for working metal by the use of a lubricating oil composition defined as claim 1.

* * * * *